US011052511B2

(12) United States Patent
Maegawa

(10) Patent No.: US 11,052,511 B2
(45) Date of Patent: Jul. 6, 2021

(54) OUTER BLADE CUTTING WHEEL AND MAKING METHOD

(71) Applicant: Shin-Etsu Chemical Co., Ltd., Tokyo (JP)

(72) Inventor: Harukazu Maegawa, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 284 days.

(21) Appl. No.: 16/001,585

(22) Filed: Jun. 6, 2018

(65) Prior Publication Data

US 2018/0354100 A1 Dec. 13, 2018

(30) Foreign Application Priority Data

Jun. 9, 2017 (JP) ..... JP2017-114170

(51) Int. Cl.
*B24D 5/12* (2006.01)
*B24D 18/00* (2006.01)
*B28D 1/12* (2006.01)

(52) U.S. Cl.
CPC ..... *B24D 5/12* (2013.01); *B24D 18/0018* (2013.01); *B28D 1/121* (2013.01)

(58) Field of Classification Search
CPC ..... B24D 5/12; B24D 18/0018; B28D 1/121
See application file for complete search history.

(56) References Cited

U.S. PATENT DOCUMENTS 5,443,418 A * 8/1995 Frodin ..... B24D 3/06 451/540
6,098,609 A * 8/2000 Ishizuka ..... B24B 5/12 125/13.01

(Continued)

FOREIGN PATENT DOCUMENTS

JP 52-15834 B1 5/1977
JP H02-117862 U 9/1990

(Continued)

OTHER PUBLICATIONS

Extended European Search Report dated Oct. 31, 2018, issued in counterpart application No. 18175754.3. (9 pages).

(Continued)

*Primary Examiner* — Dung Van Nguyen
(74) *Attorney, Agent, or Firm* — Westerman, Hattori, Daniels & Adrian, LLP

(57) ABSTRACT

An outer blade cutting wheel is provided comprising an annular thin disc base and a blade section of bonded abrasive grains on the periphery of the base. Provided that an imaginary range is delineated by two imaginary planes extending parallel to the planar surfaces of the base and tangent to widthwise side portions of the blade section and two imaginary circumferences defined about the rotational axis and extending tangent to inner and outer perimeters of the blade section, the blade section occupies 10-40% by volume of the imaginary range minus the region of the base, and the widthwise side portions of the blade section have a dented shape relative to the imaginary planes. The cutting wheel is capable of cutoff machining at a high feed speed while maintaining a high accuracy and a low cutting load.

14 Claims, 6 Drawing Sheets

(56) References Cited

U.S. PATENT DOCUMENTS

| | | | | |
|---|---|---|---|---|
| 6,890,250 | B1 * | 5/2005 | Kim | B24D 5/00 451/541 |
| 7,100,595 | B2 * | 9/2006 | Koike | B23D 61/025 125/12 |
| 8,459,246 | B2 * | 6/2013 | Kasashima | B24D 3/06 125/15 |
| 9,016,269 | B2 | 4/2015 | Kasashima et al. | |
| 2009/0011693 | A1 | 1/2009 | Cho | |
| 2010/0215451 | A1 * | 8/2010 | Jo | B28D 1/121 408/204 |
| 2014/0187130 | A1 * | 7/2014 | Gosamo | B24D 18/0009 451/542 |
| 2014/0373693 | A1 * | 12/2014 | Gosamo | B28D 1/121 83/39 |

FOREIGN PATENT DOCUMENTS

| | | | |
|---|---|---|---|
| JP | H08-290362 | A | 11/1996 |
| JP | 9-174441 | A | 7/1997 |
| JP | 10-175171 | A | 6/1998 |
| JP | 10-175172 | A | 6/1998 |
| JP | H11-028670 | A | 2/1999 |
| JP | 3121394 | B2 | 12/2000 |
| JP | 2003-53670 | A | 2/2003 |
| JP | 2009-172751 | A | 8/2009 |
| JP | 2013-013966 | A | 1/2013 |
| WO | 00/30810 | A1 | 6/2000 |

OTHER PUBLICATIONS

Office Action dated Jun. 2, 2020, issued in counterpart JP application No. 2017-114170, with English translation. (6 pages).

* cited by examiner

OUTER BLADE CUTTING WHEEL AND MAKING METHOD

CROSS-REFERENCE TO RELATED APPLICATION

This non-provisional application claims priority under 35 U.S.C. § 119(a) on Patent Application No. 2017-114170 filed in Japan on Jun. 9, 2017, the entire contents of which are hereby incorporated by reference.

TECHNICAL FIELD

This invention relates to an outer-diameter blade cutting wheel suited for cutting rare earth sintered magnets, and a method for preparing the same.

BACKGROUND ART

A method for cutoff machining a rare earth sintered magnet block using an outer-diameter (OD) blade cutting wheel is well known. The method is implemented by mounting an outer blade cutting wheel on a common sawing machine, and has many advantages including a good dimensional accuracy, a high machining speed and improved mass productivity. Owing to these advantages, the OD blade cutting method is widely used in the cutting of rare earth sintered magnet blocks.

OD blade cutting wheels for cutting rare earth permanent magnets are typically constructed by furnishing a cemented carbide base, processing its periphery, and bonding diamond or CBN abrasive grains thereto by metal or resin bonding. Since diamond or CBN abrasive grains are bonded to the cemented carbide base, the base is improved in mechanical strength over prior art alloy tool steel or high-speed steel, and an improvement in machining accuracy is achieved. The cemented carbide base allows the blade to be thinned, leading to improvements in manufacturing yield and machining speed.

Cemented carbides obtained by sintering WC along with Ni or Co are extremely high rigidity materials having a Young's modulus of 450 to 700 GPa, as compared with iron alloy materials of the order of 200 GPa. A high Young's modulus implies a reduced deformation of the blade under the cutting force (or resistance) thereto. For the identical cutting resistance, the blade is less deflected. For the identical deflection of the blade, cutting at the identical accuracy is possible even when the thickness of the blade is reduced. On use of a blade using a cemented carbide base, although the cutting resistance per unit area of the blade remains substantially unchanged, the cutting resistance on the overall blade becomes less by a thickness reduction of the blade. This is advantageous in the case of a multiple blade assembly having a plurality of blades wherein one or more magnet blocks are cutoff machined into a plurality of pieces at a time because the total cutting resistance on the overall blade assembly is reduced. For a motor of the identical power, the number of blades in the multiple blade assembly can be increased. For the identical number of blades, the cutting resistance is reduced, the dimensional accuracy of cutting is improved, and the motor power is saved. When the motor power has a margin relative to the cutting resistance, the feed of the cutting wheel can be accelerated to reduce the cutting time.

As discussed above, the use of high rigidity cemented carbide base contributes to a significant improvement in productivity of OD blade cutoff machining. Yet the market imposes an ever strengthening demand for rare earth sintered magnet. Since productivity is improved as the machining speed is accelerated, it would be desirable to have an outer blade cutting wheel capable of cutoff machining at a higher speed and higher accuracy than the currently available cutting wheels of cemented carbide bases.

CITATION LIST

Patent Document 1: JP-A H09-174441
Patent Document 2: JP-A H10-175171
Patent Document 3: JP-A H10-175172
Patent Document 4: JP-A 2009-172751
Patent Document 5: JP-A 2013-013966
Patent Document 6: JP-B S52-15834
Patent Document 7: WO 00/30810

DISCLOSURE OF INVENTION

When rare earth sintered magnet is cut by an outer blade cutting wheel, a grinding fluid or coolant is generally supplied during the cutting step. For the outer blade cutting wheel, a high dimensional accuracy with respect to cut pieces is required. For the purpose of improving the dimensional accuracy of cutting by the outer blade cutting wheel, it is effective to efficiently supply the grinding fluid to the grinding or cutting site to cool the site, to discharge sludge from the grinding site, and to prevent the wheel from chipping.

An object of the invention is to provide an outer blade cutting wheel capable of cutoff machining at a high speed and high accuracy for thereby achieving improved yields and reduced costs of machining, and a method for preparing the same.

With respect to an outer blade cutting wheel comprising an annular thin disc base and a blade section of bonded abrasive grains formed on the periphery of the base, an imaginary range is delineated by two imaginary planes extending parallel to the planar surfaces of the base and tangent to widthwise side portions of the blade section and two imaginary circumferences defined about the rotational axis of the wheel and extending tangent to inner and outer perimeters of the blade section. On this assumption, the inventor has found that the object is attained when the blade section occupies 10 to 40% by volume of the imaginary range minus the region occupied by the base, and the widthwise side portions of the blade section have a dented shape relative to the imaginary planes. The resulting outer blade cutting wheel is capable of cutoff machining at a high speed and high accuracy for thereby achieving improved yields and reduced costs of machining.

It has also been found that the outer blade cutting wheel can be advantageously prepared by clamping the base at its planar surfaces between a pair of jig segments so as to cover a portion, exclusive of the periphery, of the base where the blade section is not to be formed, and attaching a mesh member to the jig segments to define a cavity extending along and surrounding the base periphery, the mesh member having openings sufficient to allow passage of gas and liquid, but insufficient to allow passage of abrasive grains, filling the cavity with abrasive grains and closing the cavity, immersing the base, jig segments and mesh member in a plating solution, and electroplating with the base made cathode and allowing the plating metal to precipitate in the state that hydrogen gas is evolved from the cathode by electrolysis, and some hydrogen gas bubbles resulting from electrolysis are retained on the cavity-defining inner surface of the jig segments and/or mesh member, for thereby bonding the abrasive grains along with the plating metal onto the base periphery. The electroplating step is terminated before the cavity is completely filled with the abrasive grains and the plating metal, while maintaining the state that the bubbles are retained on the cavity-defining inner surface of the jig segments and/or mesh member.

In one aspect, the invention provides an outer blade cutting wheel comprising an annular thin disc base having a pair of planar surfaces and a periphery, and a blade section composed of abrasive grains and a bond and formed on the periphery of the base, the wheel being adapted to rotate about an axis. Provided that an imaginary range is delineated by two imaginary planes extending parallel to the planar surfaces of the base and tangent to widthwise side portions of the blade section and two imaginary circumferences defined about the rotational axis and extending tangent to inner and outer perimeters of the blade section, the blade section occupies 10 to 40% by volume of the imaginary range minus the region occupied by the base, and the widthwise side portions of the blade section have a dented shape relative to the imaginary planes.

In a preferred embodiment, the surface of the blade section has a concave/convex configuration composed of concave portions which are dented relative to the imaginary plane and the imaginary circumference and convex portions which are tangent to the imaginary plane and the imaginary circumference, wherein the concave portions are continuously formed in the circumferential direction of the base, and the convex portions are discontinuously formed in the circumferential direction of the base. More preferably, a convex portion which is surrounded by some concave portions and independent from other convex portions is included.

Typically, the bond is an electroplating metal.

In another aspect, the invention provides a method for preparing the outer blade cutting wheel defined above, comprising the steps of:

clamping the base at its planar surfaces between a pair of jig segments so as to cover a portion, exclusive of the periphery, of the base where the blade section is not to be formed, and attaching a mesh member to the jig segments to define a cavity extending along and surrounding the base periphery, the mesh member having openings sufficient to allow passage of gas and liquid, but insufficient to allow passage of abrasive grains, filling the cavity with abrasive grains and closing the cavity, immersing the base, jig segments and mesh member in a plating solution, and effecting electroplating with the base made cathode and allowing a plating metal to precipitate in the state that hydrogen gas is evolved from the cathode by electrolysis, and some hydrogen gas bubbles resulting from electrolysis are retained on the cavity-defining inner surface of the jig segments and/or mesh member, for thereby bonding the abrasive grains along with the plating metal onto the base periphery, wherein the electroplating step is terminated before the cavity is completely filled with the abrasive grains and the plating metal, while maintaining the state that the bubbles are retained on the cavity-defining inner surface of the jig segments and/or mesh member.

In a preferred embodiment, the jig segment includes a flange which is spaced apart from the base periphery and defines the cavity in part, and the bubbles are retained on the cavity-defining inner surface of the flange.

Preferably, the planar surfaces of the base are kept horizontal during the electroplating step. More preferably, the base is turned upside down on the way of the electroplating step.

Advantageous Effects of Invention

The outer blade cutting wheel is capable of cutoff machining at a high feed speed while maintaining a high accuracy and a low cutting load. Thus improved yields and reduced costs of machining are achievable.

BRIEF DESCRIPTION OF DRAWINGS

In the following description, like reference characters designate like or corresponding parts throughout the several views shown in the figures.

DESCRIPTION OF PREFERRED EMBODIMENTS

Figure 1B:
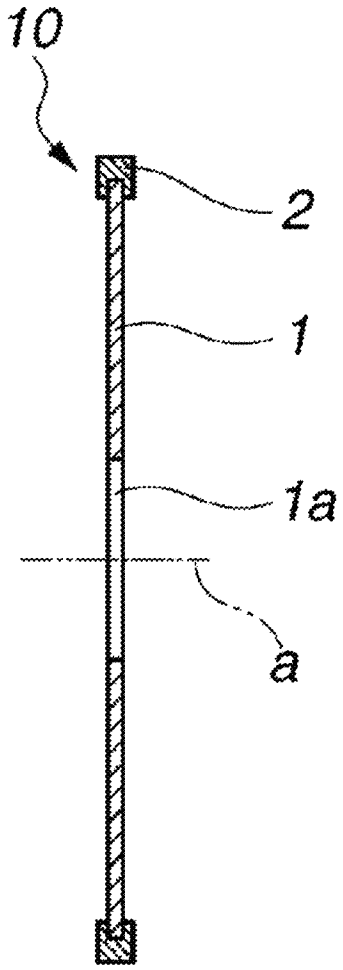
FIGS. 1A and 1B schematically illustrate an outer blade cutting wheel in one embodiment of the invention, FIG. 1A being a side view, FIG. 1B being a cross-sectional view taken along a plane passing the rotational axis of the wheel.

The invention provides an outer blade cutting wheel comprising an annular thin disc base and a blade section disposed on the periphery of the base. FIG. 1 illustrates one exemplary outer blade cutting wheel, FIG. 1A being a side view, FIG. 1B being a cross-sectional view taken along a plane passing the rotational axis of the wheel. The outer blade cutting wheel 10 is illustrated as comprising a base 1 in the form of an annular thin disc having a pair of planar surfaces, a center bore 1*a*, and a periphery, and a blade section 2 composed of abrasive grains and a bond and formed on the periphery of the base 1. The wheel is adapted to rotate about an axis a (FIG. 1B).

The base is preferably made of cemented carbide. Examples of the cemented carbide include those in which powder carbides of metals in Groups IVB, VB, and VIB of the Periodic Table such as WC, TiC, MoC, NbC, TaC and $Cr_3C_2$ are cemented in a binder matrix of Fe, Co, Ni, Mo, Cu, Pb, Sn or a metal alloy thereof, by sintering. Among these, typical WC—Co, WC—Ti, C—Co, and WC—TiC—TaC—Co systems are preferred. Also, those cemented carbides which have an electric conductivity susceptible to plating or which can be given electric conductivity with palladium catalysts or the like are preferred. The base is in the form of an annular thin disc having an outer diameter of at least 80 mm, preferably at least 100 mm, and up to 200 mm, preferably up to 180 mm, defining the periphery, an inner diameter of at least 30 mm, preferably at least 40 mm, and up to 80 mm, preferably up to 70 mm, defining the center bore 1*a*, and a thickness of at least 0.1 mm, preferably at least 0.2 mm, and up to 1.0 mm, preferably up to 0.8 mm, between a pair of planar surfaces.

Figure 1A:
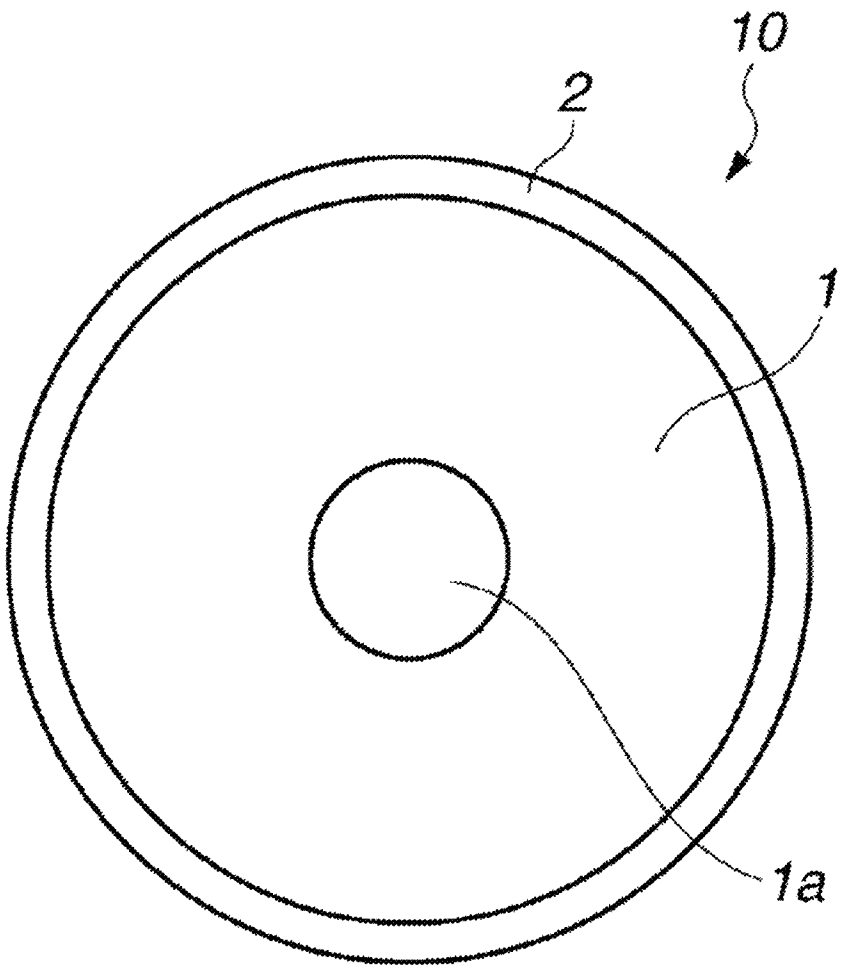

It is noted that the disc has an axis (or center bore) and a periphery as shown in FIGS. 1A and 1B. The terms "radial" and "axial" are used relative to the center of the disc. Often the width (or thickness) is an axial dimension, and the length (or height) is a radial dimension.

The blade section is formed by bonding abrasive grains with a bond to the periphery of the base. The abrasive grains used herein are preferably selected from diamond grains (naturally occurring diamond, industrial diamond), CBN (cubic boron nitride) grains, and a mixture of diamond grains and CBN grains. Preferably abrasive grains have an average grain size of 10 to 500 μm although the grain size depends on the thickness of the base. If the average grain size is less than 10 μm, there may be left smaller voids between abrasive grains, allowing problems like glazing and loading to occur during the cutting operation and losing the cutting ability. If the average grain size is more than 500 μm, faults may arise, for example, magnet pieces cut thereby may have rough surfaces.

The bond may be either a metal (inclusive of alloy) bond or a resin bond. The preferred bond is a metal bond, especially a plating metal resulting from electroplating or electroless plating because the blade section of the desired shape is readily formed on the base periphery. The metal bond used herein may be at least one metal selected from Ni, Fe, Co, Sn and Cu, an alloy of two or more of the foregoing metals, or an alloy of at least one metal selected from the foregoing metals with at least one non-metal element selected from B, P and C.

Preferably the blade section contains abrasive grains in a fraction of at least 10% by volume, more preferably at least 15% by volume and up to 80% by volume, more preferably up to 75% by volume. Less than 10 vol % means a less fraction of abrasive grains contributing to cutting whereas more than 80 vol % of abrasive grains may increase unwanted loading during the cutting operation. Either situation increases resistance during the cutting operation and so the cutting speed must be reduced. Although the blade section typically consists of abrasive grains and bond, a suitable ingredient other than the abrasive grains and bond may be mixed in a fraction of up to 10% by volume, especially up to 5% by volume for the purposes of adjusting the hardness, stress and modulus of the blade section.

The abrasive blade section of the outer blade cutting wheel has the following characteristic features distinguishable from the prior art blade sections. It is assumed that an imaginary range is delineated by two imaginary planes extending parallel to the planar surfaces of the base and tangent to widthwise side portions of the blade section and two imaginary circumferences defined about the rotational axis and extending tangent to inner and outer perimeters of the blade section. The blade section occupies 10 to 40% by volume of the imaginary range minus the region occupied by the base. The percent occupation of the blade section is preferably at least 15% by volume and up to 35% by volume of the imaginary range minus the region occupied by the base (i.e., imaginary space). In addition, the widthwise side portions (or side surfaces) of the blade section have a dented shape relative to the imaginary planes.

Figure 2:
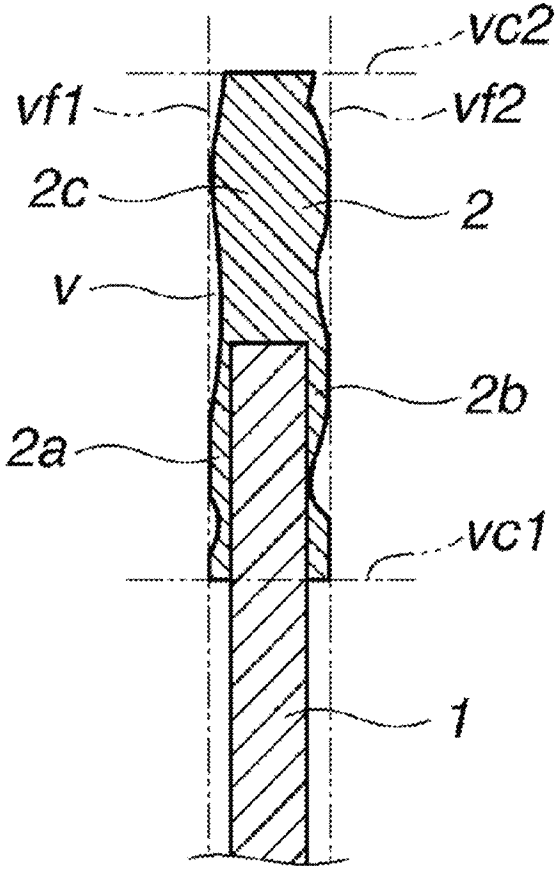
FIG. 2 is an enlarged cross-sectional view, like FIG. 1B, of a blade section of the outer blade cutting wheel.

Referring to FIG. 2, the characteristic features of the invention are described. FIG. 2 is an enlarged cross-sectional view of the blade section, taken along a plane passing the rotational axis of the cutting wheel. In conjunction with the blade section 2 on the periphery of the base 1, as shown in FIG. 2, two imaginary planes vf1, vf2 extend parallel to the planar surfaces of the base 1 and tangent to widthwise side portions of the blade section 2, specifically at the most protruding positions on the widthwise sides, and two imaginary circumferences vc1, vc2 are defined about the rotational axis a and extend tangent to inner and outer perimeters of the blade section 2, specifically at the most protruding positions on the inner and outer perimeters. Then an imaginary range v is delineated by the two imaginary planes vf1, vf2 and the two imaginary circumferences vc1, vc2. The blade section occupies 10 to 40% by volume of the imaginary range minus the region occupied by the base, that is, the range of an annulus surrounding the periphery of the base 1 and defining a rectangular cross section in a plane passing the rotational axis of the wheel and perpendicular to the base, minus the region occupied by the base.

The prior art outer blade cutting wheel includes a blade section having widthwise side portions which are configured planar and parallel to the planar surfaces of the base. Such planar side portions fail to retain the grinding fluid. In contrast, the inventive cutting wheel is characterized in that the blade section occupies up to 40% by volume of the imaginary range minus the region occupied by the base and has the widthwise side portions of a dented shape relative to the imaginary planes. Thus the grinding fluid is retained in the hollow portions (or dents) of the imaginary range which are not occupied by the blade section. Also, the contact area between the blade section and a work to be cut is accordingly reduced, and the cutting resistance therebetween is reduced. This enables cutoff machining at a high speed and improves the accuracy of high speed cutoff machining over the prior art. The dented shape relative to the imaginary plane may be any desired shape and need not be a specific one while portions of the dented shape need not be regularly arranged.

The blade section of the characteristic shape is preferably such that its side surface has a concave/convex configuration composed of concave portions dented from the imaginary plane and/or imaginary circumference and convex portions tangent to the imaginary plane and/or imaginary circumference, wherein the concave portions and/or the convex portions are discontinuously formed in the circumferential direction of the base, especially the concave portions are continuously formed in the circumferential direction of the base and the convex portions are discontinuously formed in the circumferential direction of the base. A concave/convex configuration including convex portions which are surrounded by concave portions and independent from other convex portions is more preferred. A concave/convex configuration in which the base itself or an underlay formed on the base surface constitutes part of concave portions is also acceptable. Notably, each of the widthwise side portions of the blade section may be part of a plane coincident with the imaginary plane; and the inner and outer perimeters of the blade section may be part or the entirety of a circumference coincident with the imaginary circumference. The concave and convex portions may be of any desired shape and need not be a specific shape. The concave and convex portions need not be regularly arranged.

As shown in FIG. 2, the blade section 2 consists of a pair of clamp legs 2*a*, 2*b* which straddle the distal or peripheral portion of the base 1 and a body 2*c* which extends radially outward beyond the distal portion of the base 1 so that the thickness of the blade section 2 is greater than the thickness of the base 1. Notably, the thickness of the blade section 2 is an axial distance between imaginary planes vf1 and vf2. The clamp legs 2*a*, 2*b* sandwiching the distal portion of the base 1 preferably have a length of at least 0.5 mm, more preferably at least 1 mm and up to 4 mm, more preferably up to 3 mm. Notably, the length of clamp legs 2*a*, 2*b* is a radial distance from the peripheral end of the base 1 to the imaginary circumference (inner perimeter) vc1. Each of the clamp legs 2*a*, 2*b* preferably has a thickness of at least 0.05 mm, more preferably at least 0.1 mm and up to 0.5 mm, more preferably up to 0.25 mm. Notably, the thickness of clamp leg 2*a* or 2*b* is an axial distance between imaginary plane vf1 or vf2 and the planar surface of the base 1 disposed adjacent to the imaginary plane.

The body 2*c* of the blade section 2 preferably has a length of at least 0.05 mm, more preferably at least 0.1 mm and up to 5 mm, more preferably up to 2.5 mm, depending on the size of abrasive grains. Notably, the length of body 2*c* is a radial distance from the distal end of the base 1 to the imaginary circumference (outer perimeter) vc2.

The outer blade cutting wheel is generally prepared by forming the blade section on the periphery of the base. Suitable methods include a resin bond method of using a resin bond, mixing abrasive grains with the resin, and molding the blade section of resin-bonded abrasive grains on the periphery of the base and a metal bond method of using a metal bond and molding the blade section of metal-bonded abrasive grains, with the metal bond method being preferred. The metal bond method may be either a brazing method of mixing abrasive grains with a metal and molding the blade section or a plating method. The plating method is preferred in that the blade section is effectively formed to the desired shape. The plating method may be either electroplating (or electrodeposition) or electroless plating, with the electroplating method being preferred. The plating solution inclusive of electroplating solution and electroless plating solution may be any of well-known plating solutions capable of forming the metal bond while standard plating conditions for a particular solution may be applied. The anode may be either soluble or insoluble, with the insoluble anode being preferred. The insoluble anode may be any of prior art well-known anodes used in electroplating such as Pt and Ti electrodes.

When the blade section is formed on the base periphery by the metal bond method, an underlay may be pre-formed on the base periphery. The underlay may be made of a material as exemplified above as the metal bond and formed by either brazing or plating. Also in order to enhance the bond strength established when abrasive grains are bound to the base periphery by the metal bond method, the abrasive grains may be coated by sputtering, electroless plating or the like, prior to use.

Preferably the blade section of the outer blade cutting wheel is prepared by using electroplating metal as the bond and the following method because the blade section can be easily formed to the desired shape. The method is defined as comprising the steps of:

(1) clamping the base at its planar surfaces between a pair of jig segments so as to cover a portion, exclusive of the periphery, of the base where the blade section is not to be formed, and attaching a mesh member to the jig segments to define a cavity extending along and surrounding the base periphery, the mesh member having openings sufficient to allow passage of gas and liquid, but insufficient to allow passage of abrasive grains, (2) filling the cavity with abrasive grains and closing the cavity.

(3) immersing the base, jig segments and mesh member in a plating solution, and (4) electroplating with the base made cathode and allowing the plating metal to precipitate in the state that hydrogen gas is evolved from the cathode by electrolysis, and some hydrogen gas bubbles resulting from electrolysis are retained on the cavity-defining inner surface of the jig segments and/or mesh member, for thereby bonding the abrasive grains along with the plating metal onto the base periphery. The electroplating step (4) is terminated before the cavity is completely filled with the abrasive grains and the plating metal, while maintaining the state that the bubbles are retained on the cavity-defining inner surface of the jig segments and/or mesh member.

Figure 3A:
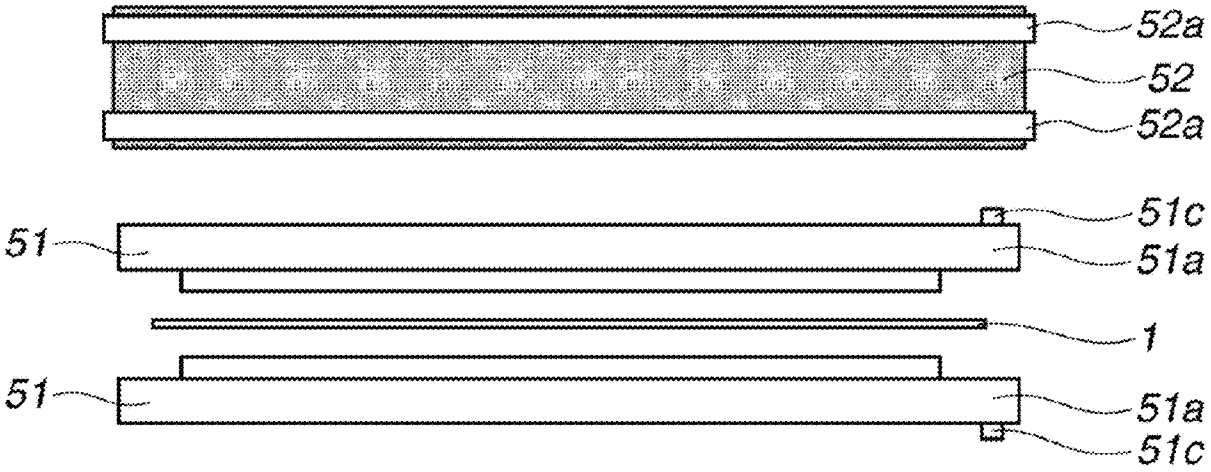
FIGS. 3A and 3B schematically illustrate a jig and a mesh member used in the preparation of the outer blade cutting wheel, FIG. 3A being an exploded side view, FIG. 3B being a cross-sectional view.
Figure 3B:
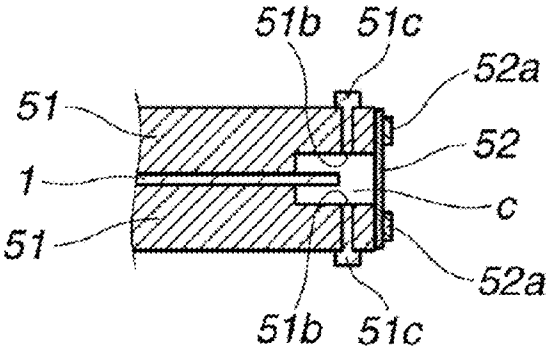

Referring to FIGS. 3A and 3B, the method is described in detail. FIGS. 3A and 3B schematically illustrate a jig and a mesh member used in the preparation of the outer blade cutting wheel, FIG. 3A being an exploded side view, FIG. 3B being a cross-sectional view. In forming the blade section on the base periphery, there are first furnished a jig consisting of segments 51, 51 and a mesh member 52. The jig segments 51, 51 are sized to cover a portion of the base 1 excluding its periphery. The mesh member cooperates with the jig segments 51, 51 to define a cavity which extends along and surrounds the base periphery. The base 1 is clamped at its planar surfaces between the jig segments 51, 51 and the mesh member 52 is extended around and attached to the circumference of the jig segments 51, 51 to define a cavity c. The mesh member 52 used herein may be a metal mesh (e.g., stainless steel mesh) or resin mesh.

Each jig segment 51 includes a flange 51*a* which is spaced apart from the base periphery and defines the cavity c in part. The flange 51*a* is provided with an inlet port 51*b* for feeding abrasive grains into the cavity c. The cavity c has a rectangular cross-sectional shape in a plane passing the rotational axis of the wheel and perpendicular to the base 1 (FIG. 3B). Also shown in FIG. 3 are a plug 51*c* which fits in the inlet port 51*b* to constitute a part of the flange 51*a*, and a band 52*a* which is wound around to hold the mesh member 52 to the periphery of the jig segment 51.

This is followed by the step of filling the cavity c with abrasive grains and closing the cavity. When the jig segments 51, 51 as shown in FIG. 3 are used, abrasive grains may be fed through the inlet port 51*b*. Once the plug 51*c* is detached, a necessary amount of abrasive grains are fed into the cavity c, after which the plug 51*c* is fitted in the inlet port 51*b* again. Abrasive grains may be fed as such or as a slurry of abrasive grains in a liquid such as plating solution or water. In the latter case, extra liquid may be discharged through the mesh member 52.

Next, the base 1, together with the jig segments 51, 51 and mesh member 52, is immersed in a plating solution. Then the cavity c is filled with the plating solution that penetrates through the mesh member 52.

Next, electroplating is carried out with the base 1 made cathode. It is noted that a conductive layer or underlay is previously formed on the surface of the base 1 if the base 1 is made of non-conductive material. During electroplating, hydrogen gas is evolved near the base 1 (cathode) at the same time as precipitation of plating metal. In the practice of the invention, plating metal is precipitated while some hydrogen gas bubbles resulting from electrolysis are retained on the cavity-defining inner surface of the jig segments 51, 51 and/or the mesh member 52, for thereby bonding the abrasive grains along with the plating metal onto the periphery of the base 1. With the progress of electroplating, bubbles are released out of the cavity c through the mesh member 52 while the plating solution is successively fed into the cavity c through the mesh member 52. In this way, the cavity c is gradually filled with abrasive grains and plating metal.

The electroplating step is terminated before the cavity c is completely filled with the abrasive grains and the plating metal, while maintaining the state that bubbles are retained on the cavity-defining inner surface of the jig segments 51, 51 and/or the mesh member 52. At this point, no plating metal precipitates on a portion within the cavity c where bubbles are retained. There is formed the blade section of characteristic shape, that is, the blade section having the widthwise side portions of desired shape, as opposed to the conventional blade section of right rectangular shape parallel to the planar surfaces of the base.

In the case of jig segment 51 shown in FIG. 3, the flange 51*a* ensures to retain bubbles. Use of such flanged jig segments is advantageous in forming the blade section of characteristic shape. Also the base 1 is preferably placed with its planar surfaces kept horizontal during electroplating. The horizontal setting ensures that abrasive grains, which are kept in contact with or in proximity to one surface of the base 1 under gravity, are bound by the plating metal. The base is turned upside down on the way of the electroplating step, which ensures that abrasive grains, which are kept in contact with or in proximity to the other surface of the base 1 under gravity, are bound by the plating metal. The placement of the base 1 with its planar surfaces kept horizontal is advantageous in that bubbles are positively retained by the flange 51*a*. The step of turning the base upside down is not limited to once, and may be repeated several times. Once the plating metal is precipitated to such an extent that abrasive grains are bound to the base, the cavity c may then be opened. In this case, for example, the mesh member is detached, and the jig segments are replaced by non-flanged jig segments, after which electroplating step is restarted as the post-treatment.

On use of the outer blade cutting wheel of the invention, various works may be cut thereby. Typical works are rare earth sintered magnets or permanent magnets including R—Co rare earth sintered magnets and R—Fe—B rare earth sintered magnets wherein R is at least one of rare earth elements inclusive of Y. R—Co rare earth sintered magnets include $RCo_5$ and $R_2Co_{17}$ systems. Of these, the $R_2Co_{17}$ magnets have a composition (in % by weight) comprising 20-28% R, 5-30% Fe, 3-10% Cu, 1-5% Zr, and the balance of Co. R—Fe—B rare earth sintered magnets have a composition (in % by weight) comprising 5-40% R, 0.2-8% B, up to 8% of an additive element(s) selected from C, Al, Si, Ti, V, Cr, Mn, Ni, Cu, Zn, Ga, Zr, Nb, Mo, Ag, Sn, Hf, Ta, and W for improving magnetic properties and corrosion resistance, and the balance of Fe or Fe and Co (Co is up to 30 wt % of Fe+Co).

EXAMPLE

Examples of the invention are given below by way of illustration and not by way of limitation.

Example 1

An annular thin disc of cemented carbide K10 having an outer diameter of 131 mm, an inner diameter of 60 mm, and a thickness of 0.4 mm was used as a base. By previous nickel electroplating in a nickel plating solution containing 70 g/L of $NiCl_2.6H_2O$, 370 g/L of $NiSO_4.6H_2O$, 45 g/L of boric acid and 2 g/L of lubricant #82 (JCU Corp.) at a temperature of 55° C., a nickel coating was formed on the periphery of the base as an underlay.

Jig segments and a mesh member as shown in FIG. 3 were combined with the base having the underlay to define a cavity extending along and surrounding the base periphery. With the plug removed, a slurry of diamond abrasive grains (ASTM #230/270) dispersed in a plating solution (described below) was fed into the cavity through the inlet port, after which the plug was fitted to close the cavity. The flanges were spaced apart a distance of 0.6 mm so that the blade section might have a width of 0.6 mm, and each of clamp legs straddling the base periphery might have a thickness of 0.1 mm and a length of 2 mm. The distance from the base periphery to the mesh member was 2 mm so that the body might have a length of 2 mm.

Next, the base together with the jig, mesh member and abrasive grains was immersed in a nickel plating solution containing 70 g/L of $NiCl_2.6H_2O$, 370 g/L of $NiSO_4.6H_20$, 45 g/L of boric acid, 2 g/L of lubricant #82 (JCU Corp.), 20 g/L of #83S (JCU Corp.) and 0.5 g/L of #81S (JCU Corp.) as brightener, with the planar surfaces of the base kept horizontal. Using the conductive underlay on the base as a cathode and a titanium case electrode as an anode, nickel electroplating was carried out at a temperature of 55° C. and a constant voltage of up to 0.7 V for a total time of 480 minutes. During electroplating, hydrogen gas evolved from the plating site. During electroplating, the procedure of interrupting electric conduction, turning the base upside down, and restarting electric conduction was repeated 4 times, every electric amount to precipitate 1 to 3 $AM/dm^2$ of nickel.

It was confirmed that abrasive grains were bound to the base, after which the jig segments and mesh member were detached. It was confirmed that the cavity had not been completely filled with abrasive grains and the plating metal, after which non-flanged jig segments were attached. Nickel electroplating under the same conditions as above was carried out for 120 minutes as post-treatment, yielding an outer blade cutting wheel.

Figure 4A:
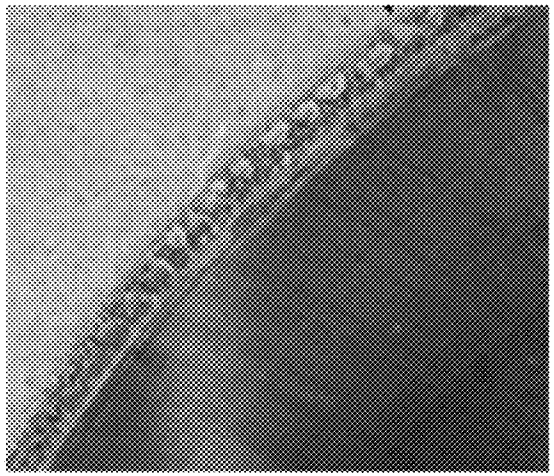
FIG. 4A is a photo showing the blade section of the outer blade cutting wheel in Example 1.

In the resulting outer blade cutting wheel, the blade section occupied 10% by volume of the imaginary range minus the region occupied by the base. FIG. 4A is a photo showing the outer appearance of the blade section of the cutting wheel. It was found that the widthwise side portions of the blade section have a dented shape relative to the imaginary planes; the side surface of the blade section is of concave/convex configuration composed of concave portions which are dented relative to the imaginary plane and the imaginary circumference and convex portions which are tangent to the imaginary plane and the imaginary circumference, wherein the concave portions are continuously formed in the circumferential direction of the base, and the convex portions are discontinuously formed in the circumferential direction of the base; and there is a convex portion which is surrounded by some concave portions and independent from other convex portions.

Comparative Example 1

An annular thin disc of cemented carbide K10 having an outer diameter of 131 mm, an inner diameter of 60 mm, and a thickness of 0.4 mm was used as a base. By previous nickel electroplating in a nickel plating solution containing 70 g/L of $NiCl_2.6H_2O$, 370 g/L of $NiSO_4.6H_2O$, 45 g/L of boric acid and 2 g/L of lubricant #82 (JCU Corp.) at a temperature of 55° C., a nickel coating was formed on the periphery of the base as an underlay.

Jig segments and a mesh member as shown in FIG. 3 were combined with the base having the underlay to define a cavity extending along and surrounding the base periphery. With the plug removed, a slurry of diamond abrasive grains (ASTM #230/270) dispersed in a plating solution (described below) was fed into the cavity through the inlet port, after which the plug was fitted to close the cavity. The flanges were spaced apart a distance of 0.6 mm so that the blade section might have a width of 0.6 mm, and each of clamp legs straddling the base periphery might have a thickness of 0.1 mm and a length of 2 mm. The distance from the base periphery to the mesh member was 2 mm so that the body might have a length of 2 mm.

Next, the base together with the jig, mesh member and abrasive grains was immersed in a nickel plating solution containing 70 g/L of $NiCl_2.6H_2O$, 370 g/L of $NiSO_4.6H_2O$, 45 g/L of boric acid, 2 g/L of lubricant #82 (JCU Corp.), 20 g/L of #83S (JCU Corp.) and 0.5 g/L of #81S (JCU Corp.) as brightener, with the planar surfaces of the base kept horizontal. Using the conductive underlay on the base as a cathode and a titanium case electrode as an anode, nickel electroplating was carried out at a temperature of 55° C. and a constant voltage of up to 0.7 V for a total time of 480 minutes. During electroplating, hydrogen gas evolved from the plating site. During electroplating, the procedure of interrupting electric conduction, turning the base upside down, and restarting electric conduction was repeated 32 times, every electric amount to precipitate 1 to 3 $AM/dm^2$ of nickel.

It was confirmed that abrasive grains were bound to the base, after which the jig segments and mesh member were detached. It was confirmed that the cavity had been completely filled with abrasive grains and the plating metal, after which non-flanged jig segments were attached. Nickel electroplating under the same conditions as above was carried out for 120 minutes as post-treatment, yielding an outer blade cutting wheel.

Figure 4B:
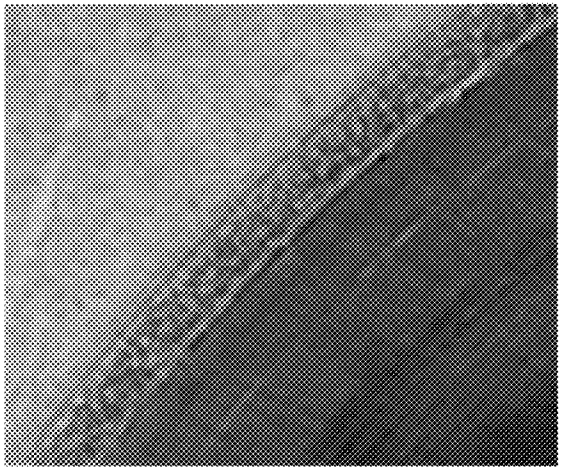
FIG. 4B is a photo showing the blade section of the outer blade cutting wheel in Comparative Example 1.

In the resulting outer blade cutting wheel, the blade section occupied substantially 100% by volume of the imaginary range minus the region occupied by the base. FIG. 4B is a photo showing the outer appearance of the blade section of the cutting wheel. The widthwise side portions of the blade section had a planar shape parallel to the planar surfaces of the base.

Figure 5:
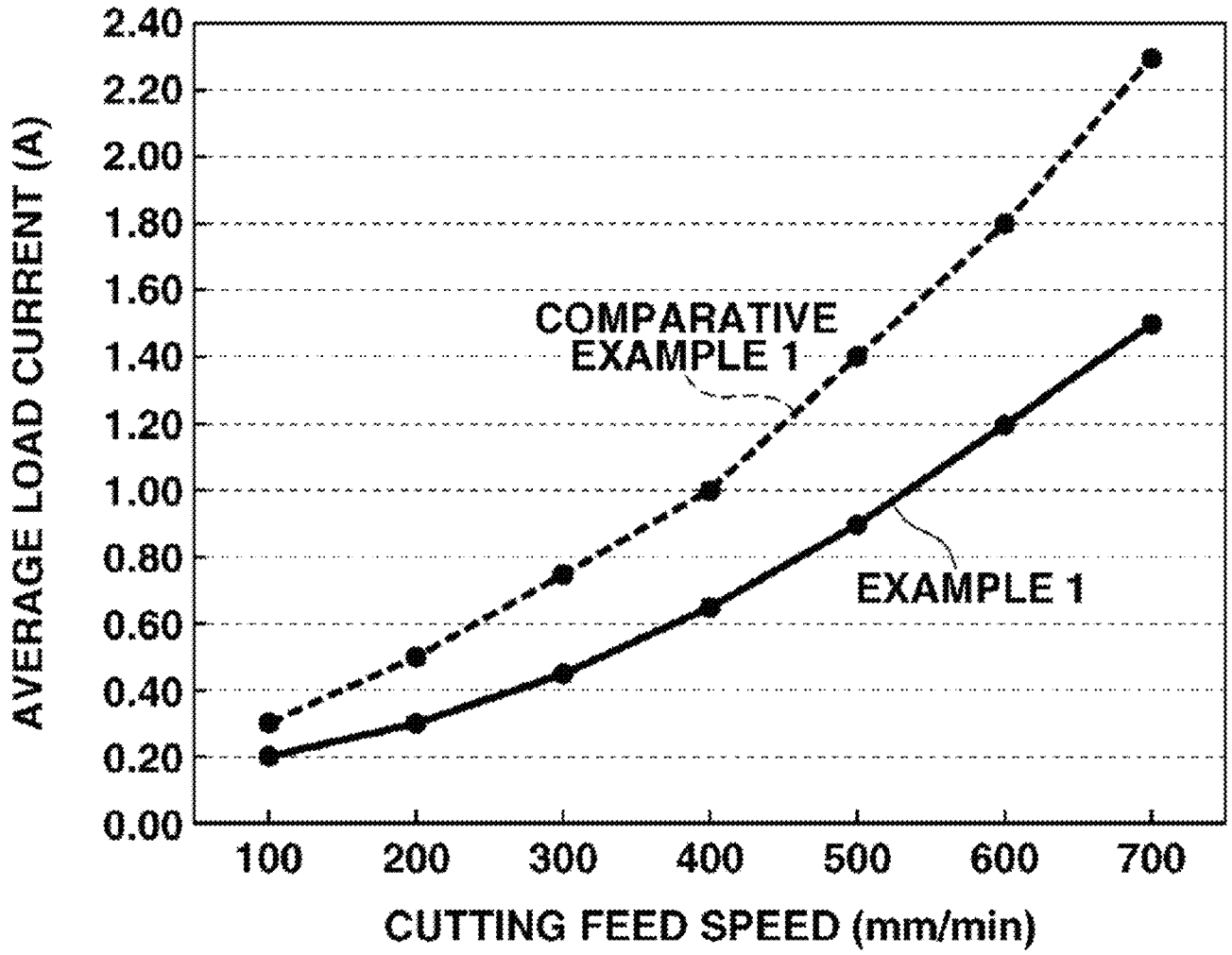
FIG. 5 is a diagram showing the average load current across the spindle motor versus the feed speed of the cutting wheel when a rare earth sintered magnet is cut by the outer blade cutting wheels of Example 1 and Comparative Example 1.
Figure 6:
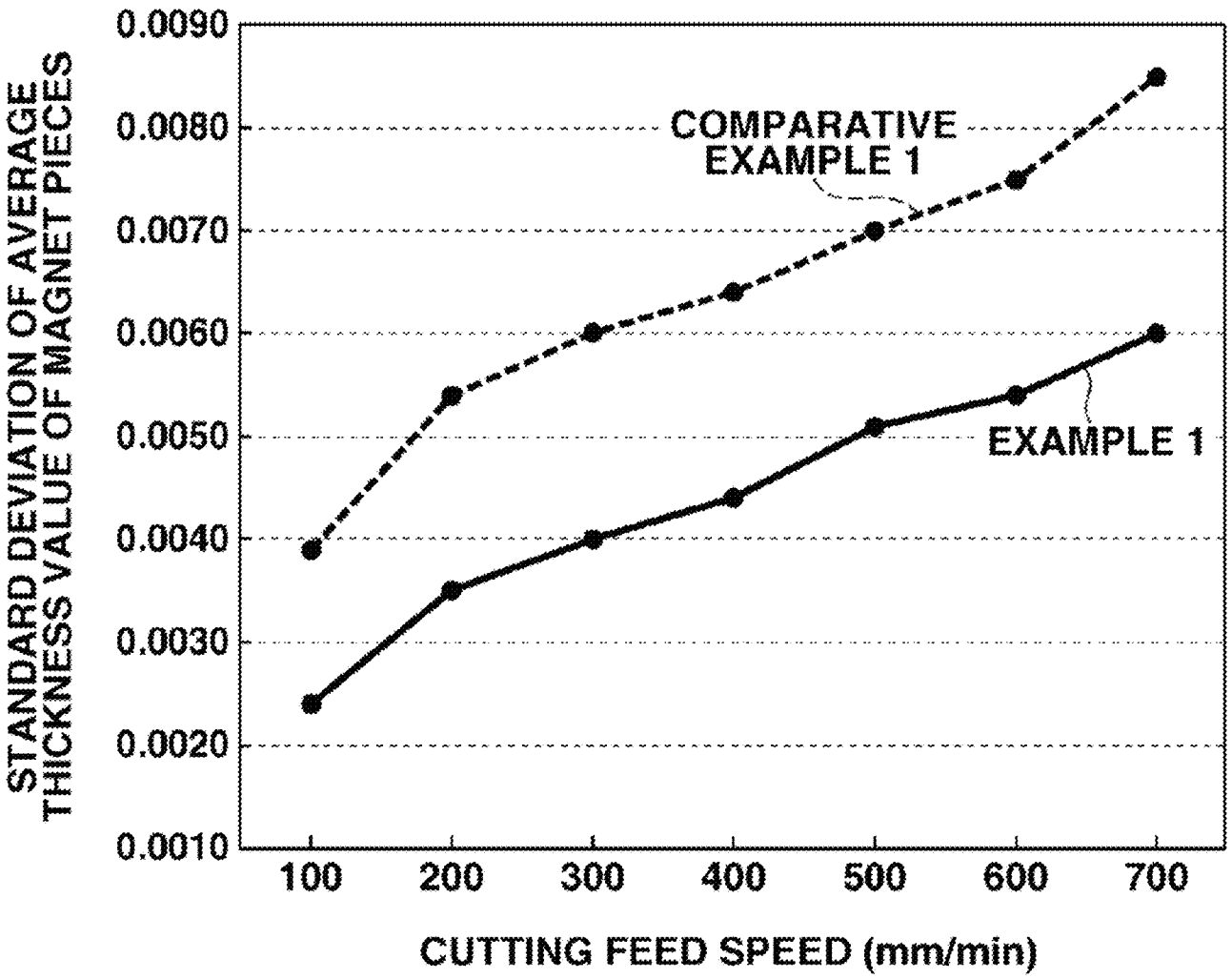
FIG. 6 is a diagram showing the average thickness of magnet pieces versus the feed speed of the cutting wheel when a rare earth sintered magnet is cut into pieces by the outer blade cutting wheels of Example 1 and Comparative Example 1.

From a R—Fe—B rare earth sintered magnet block of 40 mm long (cutting length direction of the cutting wheel) and 16 mm high (cutting depth direction of the cutting wheel), six magnet pieces of 2 mm thick were cut by using the outer blade cutting wheel of Example 1 or Comparative Example 1, and operating the cutting wheel at a rotational speed of 7,040 rpm, a cutting depth per pass of 1 mm, and a feed rate (moving rate in length direction) of 100 mm/min to 700 mm/min. During the cutting operation, the average load current across the motor for the rotating spindle of the cutting wheel was measured, with the results shown in FIG. 5. Each of the cut magnet pieces was measured for thickness at five points: 4 corners and the center, an average of which was computed. A cutting accuracy was evaluated in terms of thickness variations of magnet pieces, with the results shown in FIG. 6.

Japanese Patent Application No. 2017-114170 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. An outer blade cutting wheel comprising an annular thin disc base having a pair of planar surfaces and a periphery, and a blade section composed of abrasive grains and a metal bond and formed on the periphery of the base, the wheel being adapted to rotate about an axis, wherein provided that an imaginary range is delineated by two imaginary planes extending parallel to the planar surfaces of the base and tangent to widthwise side portions of the blade section and two imaginary circumferences defined about the rotational axis and extending tangent to inner and outer perimeters of the blade section, the blade section occupies 10 to 40% by volume of the imaginary range minus the region occupied by the base, and the widthwise side portions of the blade section have an irregular dented shape having a bottom relative to the imaginary planes, wherein the side surface of the blade section has a concave/convex configuration composed of concave portions and convex portions, the concave portions are dented relative to the imaginary plane and the imaginary circumference, at least some of the concave portions has the surface overall composed of the metal bond, and the blade section further comprises a pair of clamp legs which straddle a distal or peripheral portion of the base and a body which extends radially outward beyond the distal portion of the base so that a thickness of the blade section is greater than a thickness of the base.

2. The cutting wheel of claim 1 wherein the convex portions are tangent to the imaginary plane and the imaginary circumference, and the concave portions are continuously formed in the circumferential direction of the base, and the convex portions are discontinuously formed in the circumferential direction of the base.

3. The cutting wheel of claim 2 wherein a convex portion which is surrounded by some concave portions and independent from other convex portions is included.

4. The cutting wheel of claim 2 wherein the concave and convex portions are not regularly arranged.

5. The cutting wheel of claim 1 wherein the bond is an electroplating metal.

6. The cutting wheel of claim 1 wherein at least some of the convex portions include flat tops, and the flat tops are tangent to the imaginary plane and the imaginary circumference.

7. A method for preparing the outer blade cutting wheel comprising an annular thin disc base having a pair of planar surfaces and a periphery, and a blade section composed of abrasive grains and an electroplating metal bond and formed on the periphery of the base, the wheel being adapted to rotate about an axis, wherein provided that an imaginary range is delineated by two imaginary planes extending parallel to the planar surfaces of the base and tangent to widthwise side portions of the blade section and two imaginary circumferences defined about the rotational axis and extending tangent to inner and outer perimeters of the blade section, the blade section occupies 10 to 40% by volume of the imaginary range minus the region occupied by the base, and the widthwise side portions of the blade section have a dented shape relative to the imaginary planes, the method comprising the steps of:

clamping the base at its planar surfaces between a pair of jig segments so as to cover a portion, exclusive of the periphery, of the base where the blade section is not to be formed, and attaching a mesh member to the jig segments to define a cavity extending along and surrounding the base periphery, the mesh member having openings sufficient to allow passage of gas and liquid, but insufficient to allow passage of abrasive grains, filling the cavity with abrasive grains and closing the cavity, immersing the base, jig segments and mesh member in a plating solution, and effecting electroplating with the base made cathode and allowing a plating metal to precipitate in the state that hydrogen gas is evolved from the cathode by electrolysis, and some hydrogen gas bubbles resulting from electrolysis are retained on the cavity-defining inner surface of the jig segments and/or mesh member, for thereby bonding the abrasive grains along with the plating metal onto the base periphery, wherein the electroplating step is terminated before the cavity is completely filled with the abrasive grains and the plating metal, while maintaining the state that the bubbles are retained on the cavity-defining inner surface of the jig segments and/or mesh member.

8. The method of claim 7 wherein the jig segment includes a flange which is spaced apart from the base periphery and defines the cavity in part and the bubbles are retained on the cavity-defining inner surface of the flange.

9. The method of claim 7 wherein the planar surfaces of the base are kept horizontal during the electroplating step.

10. The method of claim 9 wherein the base is turned upside down on the way of the electroplating step.

11. The method of claim 7 wherein the side surface of the blade section has a concave/convex configuration composed of concave portions which are dented relative to the imaginary plane and the imaginary circumference and convex portions which are tangent to the imaginary plane and the imaginary circumference, wherein the concave portions are continuously formed in the circumferential direction of the base, and the convex portions are discontinuously formed in the circumferential direction of the base.

12. The method of claim 11 wherein a convex portion which is surrounded by some concave portions and independent from other convex portions is included in the blade section.

13. The method of claim 11 wherein the concave and convex portions are not regularly arranged.

14. The method of claim 7 wherein the blade section further comprises a pair of clamp legs which straddle a distal or peripheral portion of the base and a body which extends radially outward beyond the distal portion of the base so that a thickness of the blade section is greater than a thickness of the base.

* * * * *